US006974256B2

(12) United States Patent
Kinigakis et al.

(10) Patent No.: US 6,974,256 B2
(45) Date of Patent: Dec. 13, 2005

(54) FASTENER CLOSURE ARRANGEMENT FOR FLEXIBLE PACKAGES

(75) Inventors: Panagiotis Kinigakis, Buffalo Grove, IL (US); Kenneth Pokusa, Willowbrook, IL (US); Orestes Rivero, Skokie, IL (US); Joseph R. Brooks, Sterling Heights, MI (US); Kelly Elizabeth Arnold, Chicago, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 262 days.

(21) Appl. No.: 09/945,537

(22) Filed: Aug. 30, 2001

(65) Prior Publication Data

US 2002/0154836 A1 Oct. 24, 2002

Related U.S. Application Data

(63) Continuation-in-part of application No. 09/837,694, filed on Apr. 18, 2001.

(51) Int. Cl.[7] ..... B65D 33/25; B65D 33/34

(52) U.S. Cl. ..... 383/64; 383/5; 383/61.2; 383/204; 383/210

(58) Field of Search ..... 383/61.2, 64, 203, 383/204, 5, 107, 210

(56) References Cited

U.S. PATENT DOCUMENTS

| | | | |
|---|---|---|---|
| 2,994,469 | A | 8/1961 | Troup et al. |
| 3,181,583 | A | 5/1965 | Lingenfelter |
| 3,234,614 | A | 2/1966 | Plummer |
| 3,534,520 | A | 10/1970 | Moran |
| 3,579,747 | A | 5/1971 | Hawley |
| 3,660,875 | A | 5/1972 | Gutman |

(Continued)

FOREIGN PATENT DOCUMENTS

| | | |
|---|---|---|
| EP | 0443 867 A1 | 8/1991 |
| EP | 1 164 087 A2 | 12/2001 |
| JP | 55-890058 | 7/1980 |
| JP | 61-259959 | 11/1986 |
| JP | 01-226556 | 9/1989 |
| JP | 04-173510 | 6/1992 |

(Continued)

OTHER PUBLICATIONS

U.S. Appl. No. 10/251,639, filed Sep. 20, 2002.
U.S. Appl. No. 10/280,335, filed Oct. 25, 2002.
U.S. Appl. No. 10/363,436, filed Jan. 29, 2003.
Exhibit A shows drawings of a package used by the Assignee of the present invention, which is admittedly prior art with respect to the above captioned patent application. Exhibit A includes three figures describing a package which is prior art with respect to the above–captioned patent application.
"Hefty's Plastic Zipper Bag Is Rapping Rivals", by Dean Starkman, article in *The Wall Street Journal*, date unknown.
U.S. Appl. No. 09/836,984, filed Apr. 18, 2001.
U.S. Appl. No. 09/837,694, filed Apr. 18, 2001.
U.S. Appl. No. 09/945,537, filed Aug. 30, 2001.
U.S. Appl. No. 09/945,557, filed Aug. 30, 2001.

(Continued)

*Primary Examiner*—Jes F. Pascua
(74) *Attorney, Agent, or Firm*—Fitch, Even, Tabin & Flannery

(57) ABSTRACT

A flexible package is provided with a shrouded slide fastener closure. The shroud includes an opening for the slide, extending to a line of weakness joining the shroud to the remainder of the flexible package. The opening includes an acute angle portion communicating with the line of weakness to facilitate tearing of the shroud from the flexible package.

17 Claims, 12 Drawing Sheets

U.S. PATENT DOCUMENTS

| | | | | |
|---|---|---|---|---|
| 3,790,992 | A | 2/1974 | Herz | |
| 3,806,998 | A | 4/1974 | Laguerre | |
| 3,819,106 | A | 6/1974 | Schuster | |
| 4,186,786 | A | 2/1980 | Kirkpatrick | |
| 4,262,395 | A | 4/1981 | Kosky | |
| 4,355,494 | A | 10/1982 | Tilman | |
| 4,516,268 | A | 5/1985 | Kamp | |
| 4,534,158 | A | 8/1985 | McClosky | |
| 4,586,319 | A | 5/1986 | Ausnit | |
| 4,601,694 | A | 7/1986 | Ausnit | |
| 4,617,785 | A | 10/1986 | Chikatani et al. | |
| 4,646,511 | A | 3/1987 | Boeckmann et al. | |
| 4,709,533 | A | 12/1987 | Ausnit | |
| 4,727,709 | A | 3/1988 | Zieke et al. | |
| 4,745,731 | A | 5/1988 | Talbott et al. | |
| 4,812,074 | A | 3/1989 | Ausnit et al. | |
| 4,848,064 | A | 7/1989 | Lems et al. | |
| 4,878,987 | A | 11/1989 | Ven Erden | |
| 4,894,975 | A | 1/1990 | Ausnit | |
| 4,903,841 | A | 2/1990 | Ohsima et al. | |
| 4,909,017 | A | 3/1990 | McMahon et al. | |
| 4,945,714 | A | 8/1990 | Bodolay et al. | |
| 5,010,627 | A | 4/1991 | Herrington et al. | |
| 5,014,489 | A | 5/1991 | Terminella et al. | |
| 5,014,498 | A | 5/1991 | McMahon | |
| 5,020,194 | A | 6/1991 | Herrington et al. | |
| 5,036,643 | A | 8/1991 | Bodolay | |
| 5,067,208 | A | 11/1991 | Herrington, Jr. et al. | |
| 5,080,747 | A | 1/1992 | Veix | |
| 5,088,971 | A | 2/1992 | Herrington | |
| 5,127,208 | A | 7/1992 | Custer et al. | |
| 5,131,121 | A | 7/1992 | Herrington, Jr. et al. | |
| 5,140,796 | A | 8/1992 | Pope | |
| 5,141,795 | A | 8/1992 | Kai et al. | |
| 5,161,286 | A | 11/1992 | Herrington, Jr. et al. | |
| 5,167,107 | A | 12/1992 | Terminella et al. | |
| 5,179,816 | A | 1/1993 | Wojnicki | |
| 5,186,543 | A | 2/1993 | Cochran | |
| 5,189,764 | A | 3/1993 | Herrington et al. | |
| 5,211,482 | A | 5/1993 | Tilman | |
| 5,238,306 | A | 8/1993 | Heinz et al. | |
| 5,247,781 | A | 9/1993 | Runge | |
| 5,283,932 | A | 2/1994 | Richardson et al. | |
| 5,301,395 | A | 4/1994 | Richardson et al. | |
| 5,322,579 | A | 6/1994 | Van Erden | |
| 5,400,565 | A | 3/1995 | Terminella et al. | |
| RE34,905 | E | 4/1995 | Ausnit | |
| 5,405,478 | A | 4/1995 | Richardson et al. | |
| 5,417,035 | A | 5/1995 | English | |
| 5,435,864 | A | 7/1995 | Machacek et al. | |
| 5,442,837 | A | 8/1995 | Morgan | |
| 5,448,807 | A | 9/1995 | Herrington, Jr. | |
| 5,482,375 | A | 1/1996 | Richardson et al. | 383/64 |
| 5,492,411 | A | 2/1996 | May | 383/5 |
| 5,505,037 | A | 4/1996 | Terminella et al. | |
| 5,519,982 | A | 5/1996 | Herber et al. | |
| 5,525,363 | A | 6/1996 | Herber et al. | |
| 5,561,966 | A | 10/1996 | English | |
| 5,564,259 | A | 10/1996 | Stolmeier | |
| 5,664,299 | A | 9/1997 | Porchia et al. | |
| 5,664,406 | A | 9/1997 | Smith | |
| 5,669,715 | A | 9/1997 | Dobreski et al. | |
| 5,681,115 | A | 10/1997 | Diederich et al. | 383/64 |
| 5,682,730 | A | 11/1997 | Dobreski | |
| 5,687,549 | A | 11/1997 | Jostler et al. | |
| 5,713,669 | A | 2/1998 | Thomas et al. | 383/204 |
| 5,722,128 | A | 3/1998 | Toney et al. | |
| 5,725,312 | A | 3/1998 | May | 383/210 |
| 5,733,045 | A | 3/1998 | Jostler et al. | |
| 5,743,070 | A | 4/1998 | Lerner et al. | |
| 5,746,043 | A | 5/1998 | Terminella et al. | |
| 5,768,852 | A | 6/1998 | Terminella et al. | |
| 5,769,772 | A | 6/1998 | Wiley | |
| 5,775,812 | A | 7/1998 | St. Phillips et al. | 383/5 |
| 5,776,045 | A | 7/1998 | Bodolay et al. | |
| 5,782,733 | A | 7/1998 | Yeager | |
| 5,788,378 | A | 8/1998 | Thomas | |
| 5,823,933 | A | 10/1998 | Yeager | |
| 5,826,401 | A | 10/1998 | Bois | |
| 5,833,791 | A | 11/1998 | Bryniarski et al. | |
| 5,836,056 | A | 11/1998 | Porchia et al. | |
| 5,845,465 | A | 12/1998 | Bennett | |
| 5,845,466 | A | 12/1998 | Laudenberg | |
| 4,909,017 | A | 2/1999 | McMahon et al. | |
| 5,867,875 | A | 2/1999 | Beck et al. | |
| 5,871,281 | A | 2/1999 | Stolmeier et al. | 383/64 |
| 5,878,549 | A | 3/1999 | Littmann et al. | |
| 5,884,452 | A | 3/1999 | Bois | |
| 5,896,627 | A | 4/1999 | Cappel et al. | |
| 5,902,047 | A | 5/1999 | Yeager | |
| 5,904,425 | A | 5/1999 | May | |
| 5,906,438 | A | 5/1999 | Laudenberg | |
| 5,919,535 | A | 7/1999 | Dobreski et al. | |
| 5,924,173 | A | 7/1999 | Dobreski et al. | |
| 5,930,983 | A | 8/1999 | Terminella et al. | |
| 5,937,615 | A | 8/1999 | Forman | |
| 5,938,337 | A | 8/1999 | Provan et al. | |
| 5,944,425 | A | 8/1999 | Forman | |
| 5,947,603 | A | 9/1999 | Tilman | 383/64 |
| 5,950,285 | A | 9/1999 | Porchia et al. | |
| 5,956,815 | A | 9/1999 | O'Connor et al. | |
| 5,956,924 | A | 9/1999 | Thieman | |
| 5,964,532 | A | 10/1999 | St. Phillips et al. | |
| 5,983,594 | A | 11/1999 | Forman | |
| 5,985,384 | A | 11/1999 | Shibata | |
| 5,996,187 | A | 12/1999 | Tanaka et al. | |
| 6,000,197 | A | 12/1999 | Ausnit | |
| 6,019,512 | A | 2/2000 | Yeager | |
| 6,029,428 | A | 2/2000 | Terminella et al. | |
| 6,036,364 | A | 3/2000 | Heuvel | 383/64 |
| 6,044,621 | A | 4/2000 | Malin et al. | |
| 6,047,450 | A | 4/2000 | Machacek et al. | |
| 6,047,521 | A | 4/2000 | Terminella et al. | |
| 6,071,011 | A | 6/2000 | Thomas et al. | |
| 6,088,887 | A | 7/2000 | Bois | |
| 6,131,369 | A | 10/2000 | Ausnit | |
| 6,131,370 | A | 10/2000 | Ausnit | |
| 6,138,436 | A | 10/2000 | Malin et al. | |
| 6,138,439 | A | 10/2000 | McMahon et al. | |
| 6,139,662 | A | 10/2000 | Forman | |
| 6,148,588 | A | 11/2000 | Thomas et al. | |
| 6,149,302 | A | 11/2000 | Taheri | |
| 6,161,271 | A | 12/2000 | Schreiter | |
| 6,177,172 | B1 | 1/2001 | Yeager | |
| 6,178,722 | B1 | 1/2001 | McMahon | |
| 6,183,134 | B1 | 2/2001 | Malin | 383/210 |
| 6,185,907 | B1 | 2/2001 | Malin et al. | |
| 6,186,663 | B1 | 2/2001 | Ausnit | 383/63 |
| 6,199,351 | B1 | 3/2001 | Mount | |
| 6,209,287 | B1 | 4/2001 | Thiemann | |
| 6,212,857 | B1 | 4/2001 | Van Erden | |
| 6,216,423 | B1 | 4/2001 | Thieman | |
| 6,219,993 | B1 | 4/2001 | Linkiewicz | |
| 6,220,754 | B1 | 4/2001 | Stiglic et al. | 383/64 |
| 6,224,262 | B1 | 5/2001 | Hogan et al. | |
| 6,244,746 | B1 | 6/2001 | Tokita et al. | |
| 6,257,763 | B1 | 7/2001 | Stolmeier et al. | |
| 6,270,256 | B1 | 8/2001 | Todman | |
| 6,273,607 | B1 | 8/2001 | Buchman | 383/5 |
| 6,286,189 | B1 | 9/2001 | Provan et al. | |
| 6,287,000 | B1 | 9/2001 | Buchman | 383/5 |

| | | | |
|---|---|---|---|
| 6,287,001 | B1 | 9/2001 | Buchman |
| 6,290,390 | B1 | 9/2001 | Buchman |
| 6,290,391 | B1 | 9/2001 | Buchman |
| 6,290,393 | B1 | 9/2001 | Tomic |
| 6,292,986 | B1 | 9/2001 | Provan et al. |
| 6,293,896 | B1 | 9/2001 | Buchman |
| 6,327,754 | B1 | 12/2001 | Belmont et al. |
| 6,327,837 | B1 | 12/2001 | Van Erden |
| 6,347,885 | B1 | 2/2002 | Buchman |
| 6,360,513 | B1 | 3/2002 | Strand et al. |
| 6,363,692 | B2 | 4/2002 | Thieman |
| 6,364,530 | B1 | 4/2002 | Buchman |
| 6,376,035 | B1 | 4/2002 | Dobreski et al. |
| 6,378,177 | B1 | 4/2002 | Athans et al. |
| 6,386,760 | B1 | 5/2002 | Tomic |
| 6,389,780 | B1 | 5/2002 | Coomber et al. |
| 6,412,254 | B1 | 7/2002 | Tilman et al. |
| 6,427,421 | B1 | 8/2002 | Belmont et al. |
| 6,438,926 | B1 | 8/2002 | Thieman |
| 6,449,924 | B2 | 9/2002 | McMahon et al. |
| 6,470,551 | B1 | 10/2002 | Provan et al. |
| 6,474,045 | B2 | 11/2002 | McMahon et al. |
| 6,477,821 | B1 | 11/2002 | Bois |
| 6,481,183 | B1 | 11/2002 | Schmidt |
| 6,499,272 | B2 | 12/2002 | Thieman |
| 2001/0001164 | A1 | 5/2001 | Van Erden |
| 2001/0010253 | A1 | 8/2001 | Forman |
| 2001/0017950 | A1 | 8/2001 | Strand et al. ..... 383/204 |
| 2001/0039235 | A1 | 11/2001 | Buchman |
| 2001/0039783 | A1 | 11/2001 | McMahon et al. |
| 2001/0042357 | A1 | 11/2001 | McMahon et al. |
| 2001/0045083 | A1 | 11/2001 | McMahon et al. |
| 2001/0053253 | A1 | 12/2001 | Buchman |
| 2002/0017078 | A1 | 2/2002 | Thieman |
| 2002/0064320 | A1 | 5/2002 | May |
| 2002/0064321 | A1 | 5/2002 | Schreiter |
| 2002/0064322 | A1 | 5/2002 | May |
| 2002/0068668 | A1 | 6/2002 | Chow et al. |
| 2002/0076122 | A1 | 6/2002 | Buchman |
| 2002/0090489 | A1 | 7/2002 | Dobreski et al. |
| 2002/0118896 | A1 | 8/2002 | Forman |
| 2002/0134046 | A1 | 9/2002 | Bois |
| 2002/0134050 | A1 | 9/2002 | Thieman |
| 2002/0150313 | A1 | 10/2002 | Bois |
| 2002/0152719 | A1 | 10/2002 | Kinigakis et al. |
| 2002/0152720 | A1 | 10/2002 | Kinigakis et al. |
| 2002/0173414 | A1 | 11/2002 | Leighton |
| 2002/0178556 | A1 | 12/2002 | McMahon et al. |
| 2002/0184858 | A1 | 12/2002 | Ausnit et al. |
| 2002/0194818 | A1 | 12/2002 | Thieman |

FOREIGN PATENT DOCUMENTS

| | | |
|---|---|---|
| JP | 4-215954 | 8/1992 |
| JP | 5-91909 | 4/1993 |
| JP | 5-91910 | 4/1993 |
| JP | 7-112746 | 5/1995 |
| JP | 7-187202 | 7/1995 |
| JP | 9-216642 | 8/1997 |
| JP | 10-706 | 1/1998 |
| JP | 10-501714 | 2/1998 |
| JP | 10-503672 | 4/1998 |
| JP | 10-147352 | 6/1998 |
| JP | 10-203539 | 8/1998 |
| JP | 11-20051 | 1/1999 |
| JP | 11-147553 A | 6/1999 |
| JP | 11-314648 | 11/1999 |
| WO | WO 98/24704 | 6/1998 |
| WO | WO 98/45180 | 10/1998 |
| WO | WO 01/96195 A1 | 12/2001 |

OTHER PUBLICATIONS

U.S. Appl. No. 09/994,105, filed Nov. 26, 2001.
U.S. Appl. No. 09/994,111, filed Nov. 26, 2001.
U.S. Appl. No. 09/994,255, filed Nov. 26, 2001.
U.S. Appl. No. 10/099,741, filed Mar. 15, 2002.
U.S. Appl. No. 10/155,401, filed May 23, 2002.
U.S. Appl. No. 10/174,614, filed Jun. 19, 2002.
U.S. Appl. No. 10/280,335, filed Oct. 25, 2002.

FASTENER CLOSURE ARRANGEMENT FOR FLEXIBLE PACKAGES

CROSS-REFERENCE TO RELATED APPLICATIONS

This application is a continuation-in-part of U.S. patent application Ser. No. 09/837,694, filed Apr. 18, 2001.

BACKGROUND OF THE INVENTION

1. Field of the Invention

The present invention pertains to the closure of flexible packages, such as plastic bags, and in particular to fastener closures employing sliders.

2. Description of the Related Art

With the recent emphasis in providing consumers with bulk quantities of various commodities, such as food products, reclosable packages have become increasingly popular. One of the most popular means of providing reclosability is to employ zippers of various types, particularly zippers which are compatible with flexible packages of plastic film construction. Manufacturers of food products and other commodities are concerned with filling the contents of a flexible package as quickly and economically as possible. It is important that the opening provided by the fastener be made as large as practically possible. Consumers or other end users also prefer large sized openings for easy extraction of products from the package interior. Even with large openings, however, products within the package may interfere with fastener operation when the product is poured or otherwise dispensed from the package becomes entrained in the fastener components.

Other improvements to flexible reclosable packages are being sought. For example, when handling products comprised of numerous small pieces, such as shredded cheese or cereal, for example, it is generally desirable to have the package formed into a pouch which is open at one end, or along one side, so as to allow the product to be poured or shaken through the reclosable opening. It is desirable that the product be allowed to freely flow past the reclosable opening. Preferably, the path taken by the product within the package should be made as smooth as possible.

Although improvements have been made in the art of plastic welding and joining, manufacturers of consumer products employing high speed production techniques are continually seeking improved package forming methods and equipment. Concern has been focused on the formation of stop members which limit the travel of a sliding closure traveling along fastener tracks. Any reduction in the time needed to form these and other package features can result in substantial cost savings.

SUMMARY OF THE INVENTION

It is an object of the present invention to provide a shrouded flexible package with an improved fastener closure.

Another object of the present invention is to provide reclosable packages having fastener sliders which are protected during shipment and display, and afterwards, when the package contents are poured out or otherwise extracted.

A further object of the present invention is to provide a shrouded reclosable package having improved arrangements for hanging display.

Yet another object of the present invention is to provide a shrouded reclosable plastic package having a slider fastener with improved containment of the slider in a manner which also optimizes the size of the bag opening.

A further object of the present invention is to provide a shrouded plastic bag having a slider fastener with an improved end or "crush" seal of the fastener tracks.

These and other objects of the present invention are attained in a reclosable flexible package comprising opposed front and rear panels that have sides joined together to form an interior and a package opening communicating with said interior. The reclosable flexible package has first and second interlockable fastener tracks configurable in an interlocked, closed position and an unlocked open position. It has a slider movable along fastener tracks to configure tracks in interlocked position to close opening and to configure fastener tracks in unlocked position so as to allow access through opening to package interior. The fastener tracks have opposed ends located adjacent, opposed sides of front and rear panels. The stops adjacent ends of fastener tracks interfere with and prevent travel of slider beyond fastener tracks. A side seal of pre-selected width joins together one side of front and rear panels. A shroud covers slider and at least the major portion of fastener tracks. Weakening portions extend adjacent fastener tracks and severe the remainder of reclosable flexible package.

It has been determined that, in a practical commercial environment, it is difficult to employ conduction heat sealing techniques to form the slider stop. It is preferred that the stop be formed using ultrasonic sealing techniques, as these afford greater control over dimension and shape. This is important when the maximum number of advantages accorded the present invention are being sought, since the mass, and particularly the frontal surface area of the stop is reduced to the greatest extent possible.

DETAILED DESCRIPTION OF THE PREFERRED EMBODIMENTS

Figure 1:
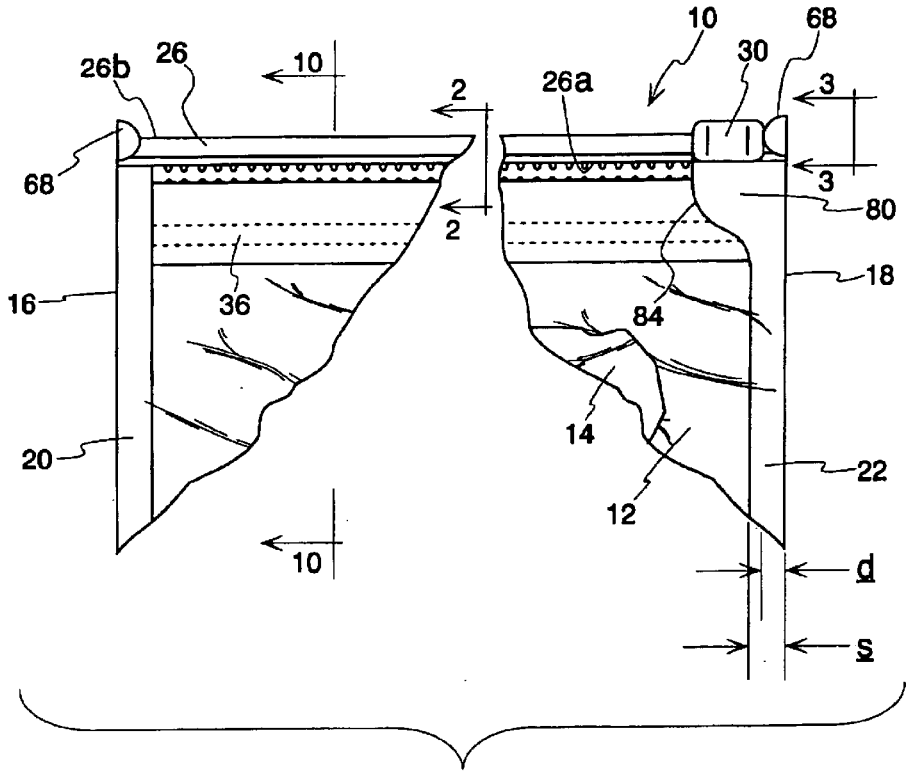
FIG. 1 is a fragmentary front elevational view of a flexible package according to principles of the present invention.

Referring now to the drawings and initially to FIGS. 1–8, a flexible package illustrating principles of the present invention is generally indicated at 10. Flexible package 10 preferably comprises a plastic bag having front and back panels 12, 14 joined together at the left end by a side seal 20 and at the right end by a side seal 22. Side seal 20 is preferably of conventional conduction heat-sealed construction, having a generally constant width throughout. Panels 12, 14 are further joined together at their bottom ends by a bottom seal 24 (see FIG. 10) extending between side seals 20, 22, as is known in the art. Alternatively, the bottom seal can be replaced by a fold line with panels 12, 14 being formed from a continuous sheet of plastic material.

Figure 2:
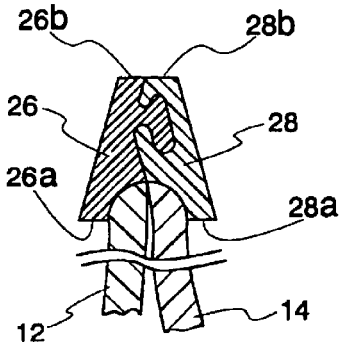
FIG. 2 is a fragmentary cross-sectional view taken along the line 2—2 of FIG. 1.

The upper end of flexible package 10 features a reclosable opening including a slide fastener arrangement with fastener tracks 26, 28 and a slider 30, all preferably of polyolefin material. The slider 30 is slidable along the fastener tracks, causing the fastener tracks to interlock or mate (as shown in FIG. 2) for closure of the flexible package and to unmate or separate to open the flexible package for access to contents in the package interior. As will be seen herein, features associated with the fastener slider arrangement allow an unprecedented enlarged opening of the flexible package. The enlarged package opening made possible by the present invention benefits manufacturers filling the package, as well as consumers dispensing product from the interior of the flexible package. In the preferred embodiment shown, the fastener tracks are also referred to as "zipper" tracks.

The flexible package according to principles of the present invention has found immediate commercial acceptance for use with food products, including perishable food products, such as cheese. Accordingly, it is generally preferred that the flexible package includes a hermetic seal 36 in the form of a peelable seal as taught in commonly assigned U.S. Pat. Nos. 5,014,856; 5,107,658 and 5,050,736, the disclosures of which are incorporated by reference as if fully set forth herein.

Figure 3:
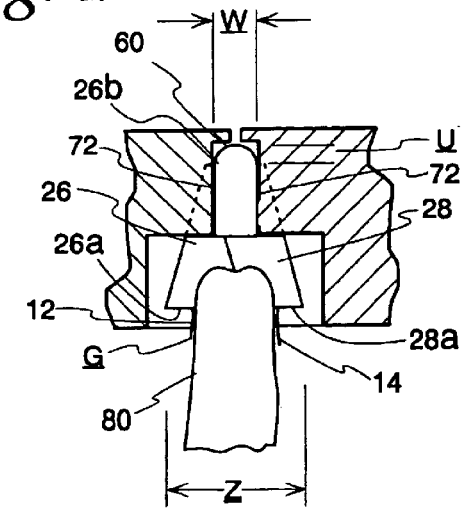
FIG. 3 is a fragmentary end view indicated by line 3—3 of FIG. 1.

As mentioned above, flexible package 10 preferably comprises a bag having panels 12,14 formed from plastic sheet material. The sheet material can be of a single material type, such as polyolefin materials including polyethylene and polypropylene, but preferably comprises a laminate assembly of several different material types, as is known in the art to provide a barrier to moisture as well as certain gases, such as oxygen or inert fillers of the types used with food products. Other types of laminate films, such as those known in the art to preserve food freshness, may be employed. Where the contents of the flexible package are not perishable or where other considerations may dictate, the panels 12, 14 can be constructed without regard to gas or vapor barrier properties. FIGS. 2 and 3 indicate that it is generally preferred that the fastener tracks be joined to web-like flanges which, in turn, are joined to panels 12, 14 as will be described below with reference to FIG. 10.

Referring now to FIGS. 5–8, fastener slider 30 has a top wall 44, a shorter side wall 46 and a longer side wall 48, cooperating to define an internal cavity 50 for receiving the fastener tracks 26, 28. As can be seen by comparing the end views of FIGS. 7 and 8, a first end 54 of the slider defines a cavity which is generally rectangular. The opposed end 56 (shown in FIG. 8) defines a cavity which is generally arrowhead or A-shaped, as indicated by reference numeral 50*b*, conforming to the outline of the interlocked fastener tracks shown in FIG. 2. When the slider 30 of FIG. 1 is moved to the right, end 56 is at the leading end of the slider and the fastener tracks 26, 28 are unlocked, thus opening the flexible package 10. Conversely, as slider 30 of FIG. 1 is moved to the left, end 54 (shown in FIG. 7) is made the leading end, and fastener tracks 26, 28 are interlocked in the manner indicated in FIG. 2, to close the flexible package.

Referring again to FIGS. 2, 7 and 8, a number of features cooperate to maintain slider 30 captive on fastener tracks 26, 28. As can be seen for example in FIG. 8, a pair of upwardly facing stepped portions 62 are formed on either side of the slider cavity. Inwardly extending protrusions 64 are located at the other end of the slider. Protrusions 64 and stepped portions 62 engage the bottoms 26*a* and 28*a* (see FIG. 2) of fastener tracks 26, 28, as can be seen for example in FIG. 10. The engagement of the stepped portions 62 and the protrusions 64 with the bottoms of the fastener tracks prevents the slider from being upwardly dislocated from the fastener tracks.

Figure 13:
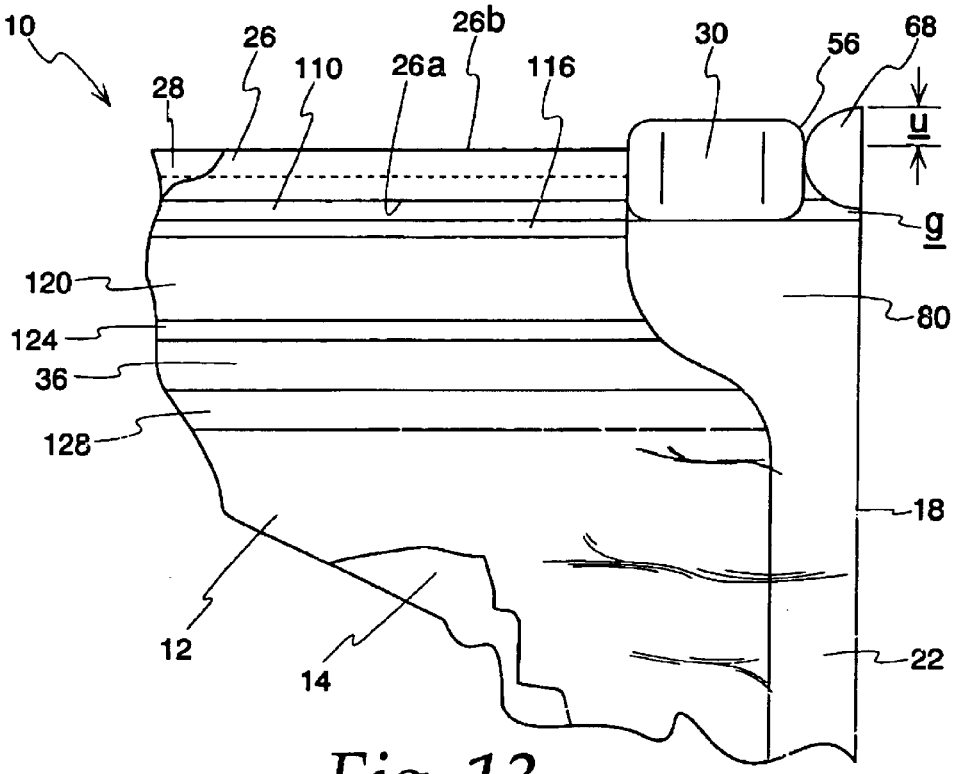
FIG.13 is a fragmentary front elevational view showing a flexible package according to principles of the present invention.

Referring to FIGS. 1, 3 and 13, the ends of the of the fastener tracks are deformed or "crushed" to form stops 68. Preferably, stops 68 are formed by the application of ultrasonically generated heat and pressure to the ends of fastener tracks 26, 28. It has been found that the use of present day conduction heat sealing techniques does not provide the control needed to attain the intricate, close tolerance design of stop members according to principles of the present invention. Further, it has been found that the use of present day conduction heat sealing techniques immediately adjacent previously formed stop members tends to distort the stop members, oftentimes to an extent rendering the stop members unacceptable from a quality control standpoint. As will be seen herein, stops 68 are configured for maximum efficiency, having the smallest front elevational surface area (i.e., the surface area visible in FIGS. 1 and 13, for example) which is adequate for containing slider 30 on the fastener tracks.

Referring to FIG. 3, the sides of the fastener tracks are softened and compressed at stop faces or sides 72 so as to impart a pre-selected width w and an upwelling displacement u above the upper surfaces 26*b*, 28*b* of fastener tracks 26, 28 (see FIG. 2). The material displaced above the upper surface of the fastener tracks interferes with the top wall 44 and ends of slider 30 to limit its sideways travel.

With reference to FIG. 3, the slider stop 68 (that is, the deformed portion of fastener tracks 26, 28) is carefully configured so as to avoid deformation of the bottom surfaces 26*a*, 28*a* of the fastener tracks. With reference to FIG. 1, the lower ends of the fastener tracks extend undeformed, substantially to the side edges 16, 18 of the flexible package 10. FIG. 1 shows slider 30 "parked" at a fully opened position, with end 56 contacting the stop 68 located at the right hand end 22 of the flexible package. Stop members 68 and the undisturbed bottom surfaces 26*a*, 28*a* of the fastener tracks in the area of stop members 68 cooperate to captivate slider 30 on the fastener tracks, preventing its unintentional removal from flexible package 10.

It is preferred that the bottom edges 26*a*, 28*a* remain undeformed also for that portion extending beyond slider 30, and underneath at least a portion of the right hand stop 68. With reference to FIG.3, a gap g is formed between the bottom edges of the fastener tracks and the top portion 81 of side seal 22. As can be clearly seen in FIG. 3, the stop 68, formed by ultrasonic techniques, is separated by a substantial distance from the side seal, which is typically formed using conduction heat seal techniques found to be incompatible with the precise, high resolution ultrasonic techniques used to form stop 68. A second stop 68 formed at the left hand end 16 of flexible package 19 is constructed in a similar fashion and extends beyond the end 54 of slider 30 when the slider is moved fully to the left, closing the upper end of the flexible package. As will be explained in greater detail herein, separation of the "crush" operation performed on the fastener tracks to form stops 68 from the conduction heat sealing operation to form the enlarged side seals, allow stops 68 to take on a reduced size, effectively extending the size of the package opening, without sacrificing ability of the stops to effectively retain slider 30 on the fastener tracks.

Figure 4:
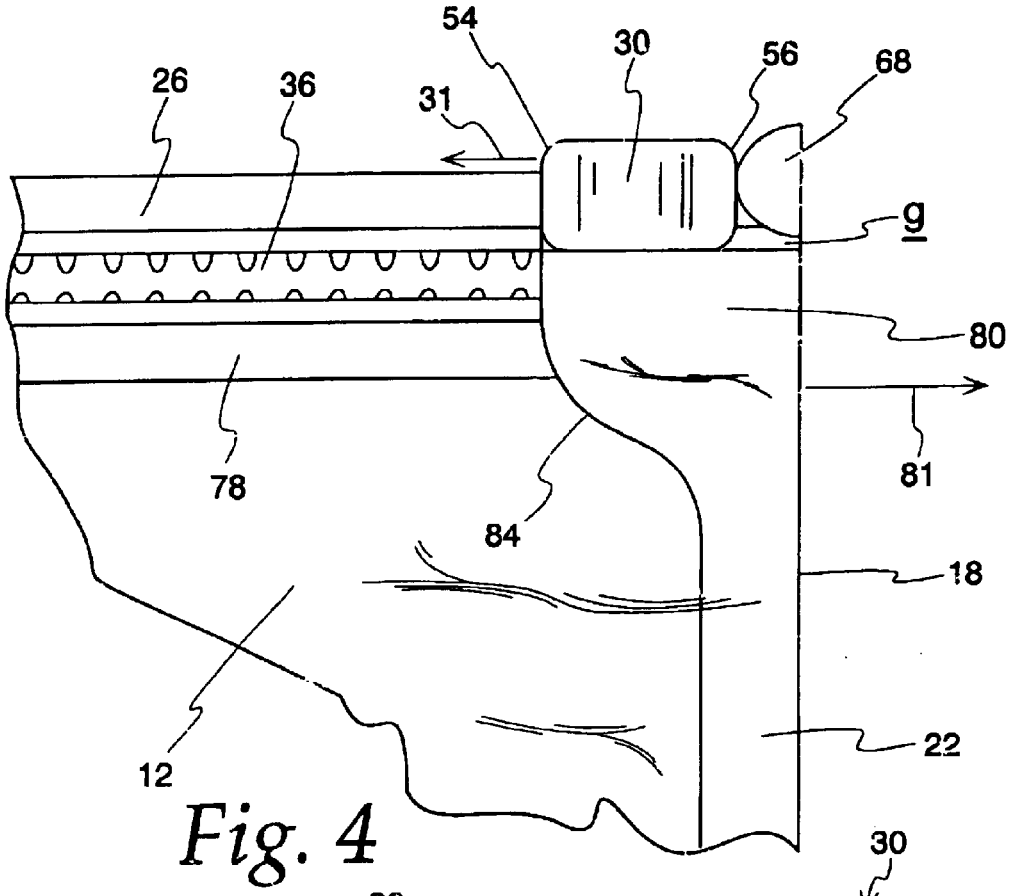
FIG. 4 is fragmentary front elevational view showing construction of the flexible package.
Figure 5:
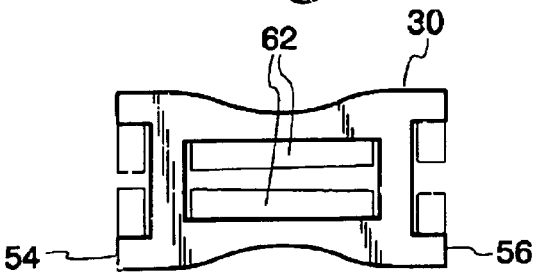
FIG. 5 is a top plan view of the slider member.
Figure 6:
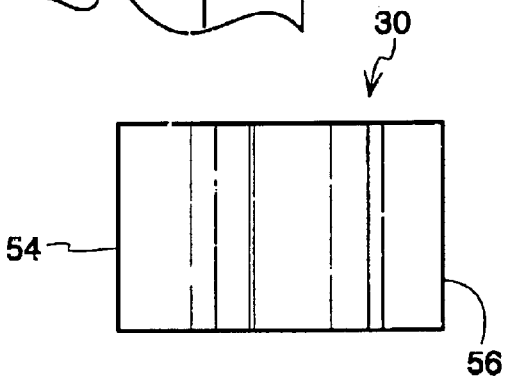
FIG. 6 is a front elevational view thereof.
Figure 7:
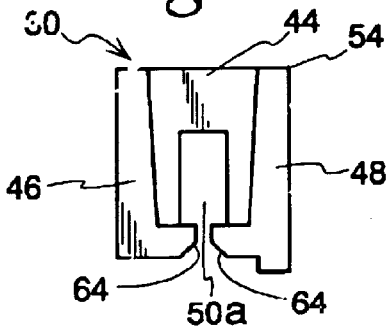
FIG. 7 is an elevational view from one end thereof.
Figure 8:
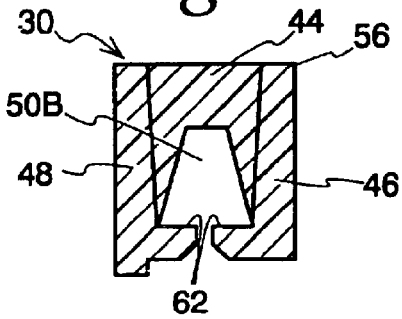
FIG. 8 is an elevational view from the other end thereof.

Referring to FIGS. 1 and 4, side seal 22 includes an upper enlarged or tapered portion 80 having a width substantially greater than the lower end of side seal 22, sufficient to underlie the substantial entirety of slider 30 when the slider is fully moved to the "parked" position as shown in FIG. 1. The width of the enlarged, tapered portion 80 ranges between 200% and 400% (or more for very narrow side seals, e.g., 2 mm or less) of the width s of side seal 22 and most preferably ranges between 250% and 300% of the side seal width s.

Figure 11:
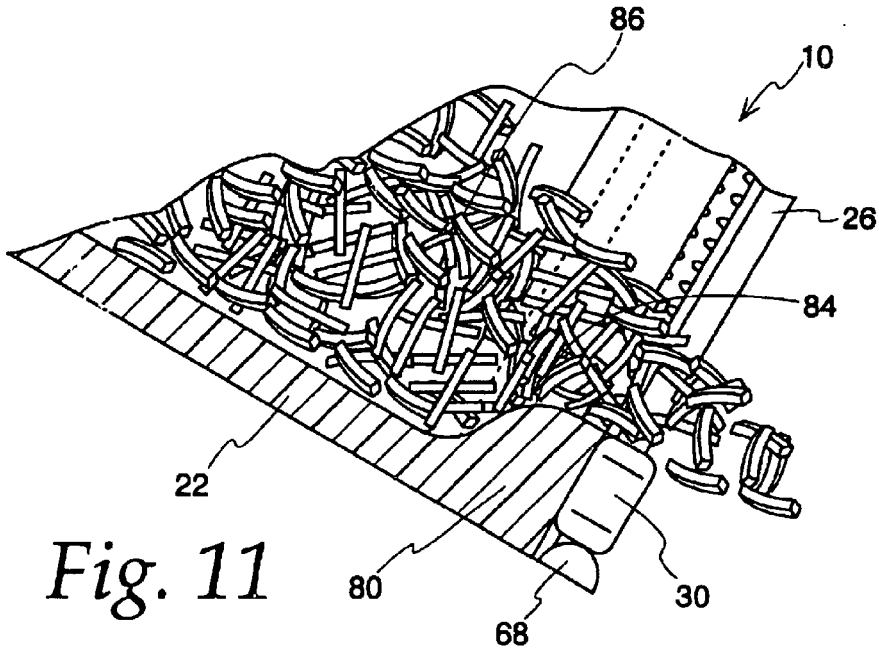
FIG. 11 is a fragmentary front elevational view showing contents being poured from the flexible package.

The enlarged, tapered end 80 of side seal 22 has a S-shaped or double re-entrant bend contour 84 which partly defines the package interior. With reference to FIG. 11, the curved edge 84 of the enlarged side seal portion 80 provides a smooth transition at the corner of the package opening, preventing product entrapment within the flexible package. As those skilled in the art will appreciate, the smooth transition at the opening corner is especially beneficial for flexible packages, where shaking techniques otherwise suitable for rigid packages, are rendered largely ineffective by flexible panels 12, 14 and especially panels of very thin, unsupported material which are likely to collapse in use.

Figure 12:
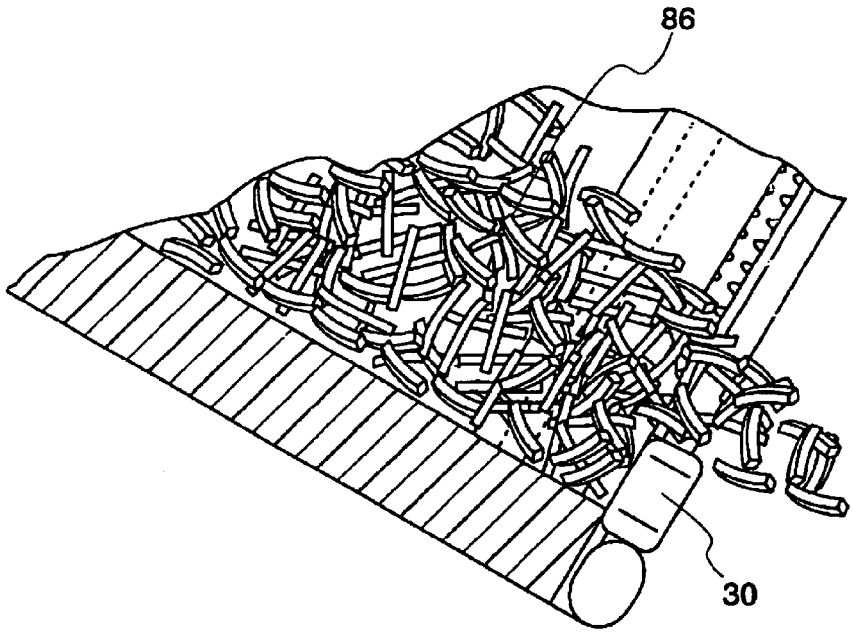
Fig. 12 Prior Art
FIG. 12 is a fragmentary front elevational view showing contents of a prior art package.

The smooth transition provided by curved edge 84 also deflects or guides product 86 away from slider 30 as product is poured or otherwise removed from flexible package 10. This prevents contamination of mating surfaces of the slider and the fastener tracks, which would otherwise deteriorate the ability of slider 30 to move freely, performing interlocking and unlocking of the fastener tracks. As indicated in FIG. 12, in prior art arrangements product 86 is allowed to freely contact the bottom end of slider 30, a condition which is avoided by flexible packages according to principles of the present invention.

Preferably, fastener tracks 26, 28 are "crushed" to form stop member 68, using conventional ultrasonic heating equipment which allows for a highly accurate shaping of the stop member as well as withdrawal of the deformation area away from the bottom surfaces 26*a*, 28*a* as shown, for example, in FIG. 3. As can be seen for example in FIG. 1, the width of stop member 68 is considerably less than the enlarged tapered portion 80 of side seal 22, and preferably is of a smaller width than that of the narrower major portion of side seal 22. With reference to FIG. 1, the width d of stop member 68 is less than the width s of side seal 22. Preferably, stop member width d ranges between 50% and 200% of the width s of side seal 22. Preferably, the width w of the stop member 68 (i.e., the "crush" dimension) ranges between 25% and 80% of the width z of the fastener tracks, as illustrated in FIG. 3. The amount of upward displacement or upwelling u is approximately at least as great as the thickness of upper wall 44. It should be kept in mind that the total mass of the stop must be sufficient to hold the slider captive.

The stop member 68, in addition to having a reduced width d in front elevational view and a small width w in end view (see FIG. 3), has a sufficiently smaller mass and frontal surface area than stops employed in the prior art. This construction allows the slider 30 to be moved to an extreme position immediately adjacent the edge 22 of flexible package 10, thus maximizing the package opening, allowing for easier removal of the package contents. This reduced size of stop 68 also contributes to the precision of the ultrasonic heating and formation of the stop member, needed to attain required precise dimensions. Further, from a manufacturing standpoint, the dwell time to melt and shape the stop 68 is substantially reduced, contributing to the overall efficiency for the package manufacturer.

In contrast to the present invention, prior art stop members have been formed by "crushing" the entire fastener profile, including the bottom surfaces 26*a*, 28*a*. In addition, even if ultrasonic techniques are employed for the stop member, prior art side seals (formed using conduction heat seal techniques and much larger, oftentimes three to four times larger than side seals according to the present invention) were typically overlaid with the stop, contributing to a substantial distortion of the stop structure. Even if the prior art side seals were made to stop short of the fastener tracks, the relatively high-level of conduction heating in the immediate proximity of the stop have been found to cause a distortion of the stop, degrading control over its size and shape. These disadvantages are avoided with practice of the present invention, where the small, compact size of the stop is employed, and the gap g is formed between undeformed fastener bottom surfaces 26*a*, 28*a* and the enlarged seal portion 80.

Figure 9:
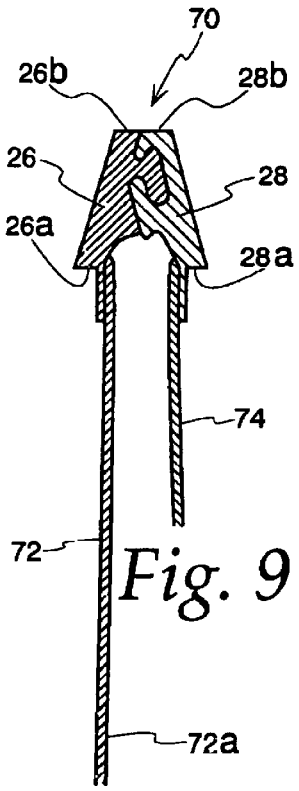
FIG. 9 is an end view of a fastener track sub-assembly.
Figure 10A:
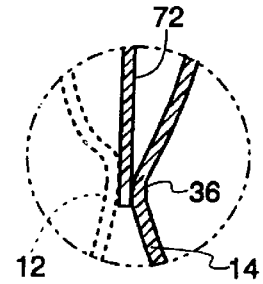
FIG. 10*a* is a fragmentary view, of FIG. 10 shown on an enlarged scale.
Figure 10:
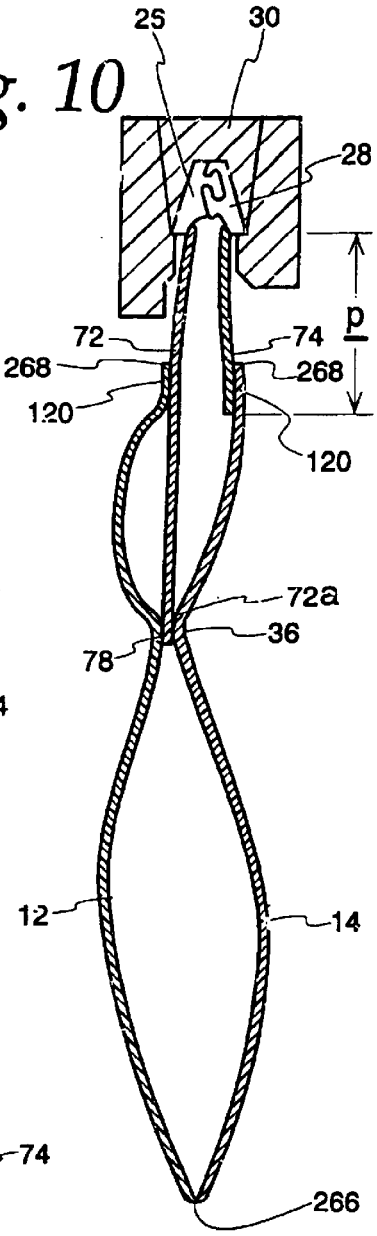
FIG. 10 is a cross-sectional view, in schematic form, taken along the line 10—10 of FIG. 1 with the slider moved to the left.
Figure 10B:
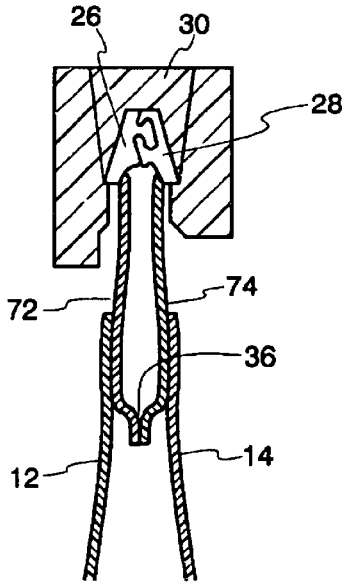
FIGS. 10*b* and 10*c* show alternative seal constructions.
Figure 10C:
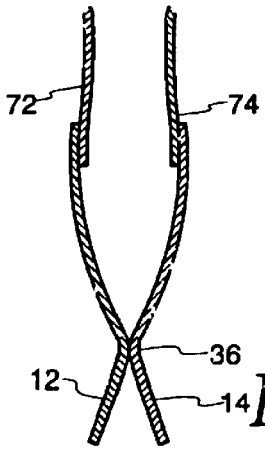

Turning now to FIGS. 4, 9 and 10, and initially to FIG. 9, the fastener tracks are preferably formed from a subassembly generally indicated at 70 in which the fastener tracks 26, 28 are provided with corresponding fastener flanges 72, 74. The fastener flanges 72, 74 are co-extensive with the fastener tracks 26, 28 and take the form of a plastic web to be heat sealed to the panels 12, 14. As can be seen in FIG. 9, fastener flange 74 is shorter in height than fastener flange 72, so as to accommodate the preferred hermetic seal arrangement shown in FIG. 10. The fastener flanges 72, 74 are heat sealed to panels 12, 14. With reference to FIGS. 4 and 10, fastener flange 72 is welded or otherwise mechanically sealed to panel 12 at weld band 78. As shown at the upper portion of FIG. 10, the upper ends of panels 12, 14 are joined to the outer outwardly facing surfaces of fastener flanges 72, 74 at points intermediate the fastener tracks and peelable seal 36. Band 36 preferably comprises a hermetic peelable seal formed by the joinder of panel 14 to the inside face 72*a* of fastener flange 72 (see FIGS. 10 and 10*a*). Panel 12 is sealed to the opposite outside face of the fastener flange as schematically indicated in FIG. 10. In FIG. 10*a* the components of the peelable seal 36 are shown, with film 12, which plays no part in the preferred peelable seal, being shown in phantom. Variations of the peelable seal are also contemplated by the present invention. For example, in FIG. 10*b*, the flanges 72, 74 of the fastener arrangement are joined with a peelable seal. The upper ends of these flanges are heat sealed to panels 12, 14 as shown. In FIG. 10*c* a further alternative is shown with the peelable seal 36 being formed at the joinder of lower portions of panels 12,14. the upper portions of panels 12, 14 are heat sealed to fastener flanges 72, 74.

As will now be appreciated, the enlarged, tapered end portions 80 of side seal 22 cooperate with other features of flexible package 10 to provide a number of important advantages. More specifically, the enlarged tapered end portions 80 provide a smooth transition of the interior of flexible package 10 preventing product entrapment in the slider and fastener track surfaces when the product is poured or otherwise dispensed. In addition, the enlarged tapered portion 80 helps to secure slider 30 about tracks 26, 28 by maintaining a clearance from bottom surfaces 26*a*, 28*a* of the fastener tracks. Further, the enlarged tapered portions 80 of side seals 22 strengthen and rigidify edge portions of panels 12, 14 in the immediate area of the parked position of slide 30.

Often, the greatest amount of force applied by the user to slider 30 occurs at the closing of the slider, when the fastener tracks are unlocked or separated from one another. When the slider 30 is in the middle of its travel along the fastener tracks, the user is provided with a sensation of the proper direction of slider movement. However, when the slider 30 is in the parked position, and especially in the "parked open" position shown in FIG. 1, the user's initial application of force may be misdirected. The enlarged tapered portion 80 provides added stiffness and rigidity to the flexible package at the initial point where pressure is applied to the slider, thus further contributing to the assurance that secure engagement will be maintained between slider 30 and the tracks 26, 28.

With reference to FIG. 4, a consumer desiring to close the flexible package will grasp the enlarged side seal portion 80, pulling in the direction of arrow 81 while pulling or pushing slider 30 in the direction of arrow 31. The added stiffness and rigidity offered by enlarged side seal portion 80 is provided at a point of optimal effectiveness to react in an appropriate manner to forces applied to slider 30 and to overcome any resistance of the tracks 24, 26 to resume a mating, interlocked condition as the fastener tracks are interlocked. Those skilled in the art will appreciate that the "rolling resistance" or dynamic resistance to movement of slider 30 is oftentimes lower than the initial static resistance, opposing movement of the slider away from the fully opened parked position shown, for example, in FIG. 4.

The added stiffness and rigidity imparted to the flexible package 10 and especially panels 12, 14 by enlarged side seal portion 80 results in other advantages when lightweight panels 12, 14 are employed. For example, panels of the single polyolefin type where no laminate film (such as PET or NYLON) is used to stiffen and support the support panel, have oftentimes excluded the use of sliding zippers, since minimum stiffness and rigidity needed to operate a fastener slider was not available. However, with enlarged side seal portions according to principles of the present invention, adequate stiffness is provided, even for lightweight, so-called "single" films.

As indicated in FIG. 10, flanges 72, 74 are joined to respective panels 12, 14, preferably at their lower ends, so as to prevent product from entering between flange 72 and panel 12, as well as between flange 74 and panel 14. In certain applications this may not be a critical requirement. In FIG. 10, the upper portion of panel 12 is shown for illustrative purposes as spaced from the lower end of flange 72. In practice, it is generally preferred that this spacing be eliminated, with panel 12 being in intimate contact with flange 72. Similarly, any gap between panel 14 and the lower end of fastener flange 74 is preferably eliminated. Although it is most preferred that the peelable seal be formed by joining panel 14 to fastener flange 72, the peelable seal, preferably a hermetic seal, can be formed between the fastener flanges 72, 74 or directly between the panels 12, 14, although these alternative constructions are less preferred than the arrangement shown in FIG. 10.

Turning now to FIG. 13, flexible package 10 is shown constructed with the panels 12, 14, side seal 22, upper enlarged side seal portion 80 and fastener tracks 26, 28, as described above. The fastener tracks 26, 28 are preferably joined to flanges 72,74 (not visible in FIG. 13). FIG. 13 schematically illustrates commercial fabrication of flexible package 10. As will be appreciated by those skilled in the art, practical commercial assembly requires recognition of tolerances of the equipment and materials used to construct a viable commercial product. For example, tracks 26, 28 are ultimately mechanically coupled to panels 12, 14 using conduction heat seal tooling. A gap 110 shown in FIG. 13 represents the tolerance range or margin of error for tool alignment used to secure the fastener tracks 26, 28. As mentioned, it is preferred that the upper end of enlarged side seal portion 80 be spaced below the lower ends of the fastener tracks, such as the lower end 26*a* of fastener track 26, visible in FIG. 13. Further, it is preferred that the gap g continue beyond the end 56 of slider 30.

A gap 116 represents a tolerance range or margin of error for the desired positioning of the upper end of enlarged side seal portion 80, to provide clearance for the bottom edge of slider 30. As illustrated in FIG. 13, the upper end of enlarged side seal portion 80 falls at an outermost limit of its tolerance range. Preferably, the upper end of enlarged side seal portion 80 is within the gap 116, rather than to one end thereof. The gap 116 also accounts for any cant or angular mispositioning or mis-alignment where the upper end of side seal 80 may be angled slightly from a position parallel to the fastener tracks, as may be encountered in a practical commercial environment.

A band 120 shown in FIG. 13 represents a conduction heat seal of the fastener flange to the panels 12 or 14. This conduction heat seal 120 provides the principal mechanical attachment of the fastener track assembly to the package panels. Band 36 is the peelable seal, preferably a hermetic seal, between panel 14 and fastener flange 72. A gap 124 represents the desired production spacing between production seal 120 and peelable seal 36. The remaining band 128 represents the production tolerance range or margin of error for positioning of peelable seal 36 with respect to the package panels.

In one commercial embodiment, flexible package 10 comprises a plastic bag having a width of approximately 6.5 inches from side edge to side edge and a total overall height of approximately 10.75 inches. The fastener tracks 26,28 have a height of approximately 4 millimeters, with gaps 110, 116 each having a height of 2 millimeters. As shown in the upper right hand corner of FIG. 13, stop 68 projects a distance u above the top edge of the fastener tracks. In FIG. 13, only the top edge 26*b* is visible. With reference to FIG. 10, the upper ends of panels 12, 14 are preferably spaced a distance p from the bottom edges of the fastener tracks, ranging between 2 and 3 millimeters. The conduction heat seal 120 and the peelable seal 36 each have a height of 6 millimeters, and gap 124 located between the two, has a height of 2 millimeters. The desired spacing between conduction heat seal 120 and peelable seal 36 has a maximum value of 2 millimeters and a minimum value required to prevent overlap of the conduction heat seal and peelable seal. The side seal 22 has a width ranging between 3 and 8 millimeters and the stop 68 has a width (see reference character d in FIG. 1) ranging between 8.0 and 13.0 mm. As can be seen with reference to FIG. 13, the upper end of side seal 22 is spaced a substantial distance below the upper edge of the flexible package. This spacing ranges between a minimum value equal to the combined height of the fastener tracks and gap 110, and a maximum value equal to the combined height of the fastener tracks, gap 110 and gap 116.

Figure 14:
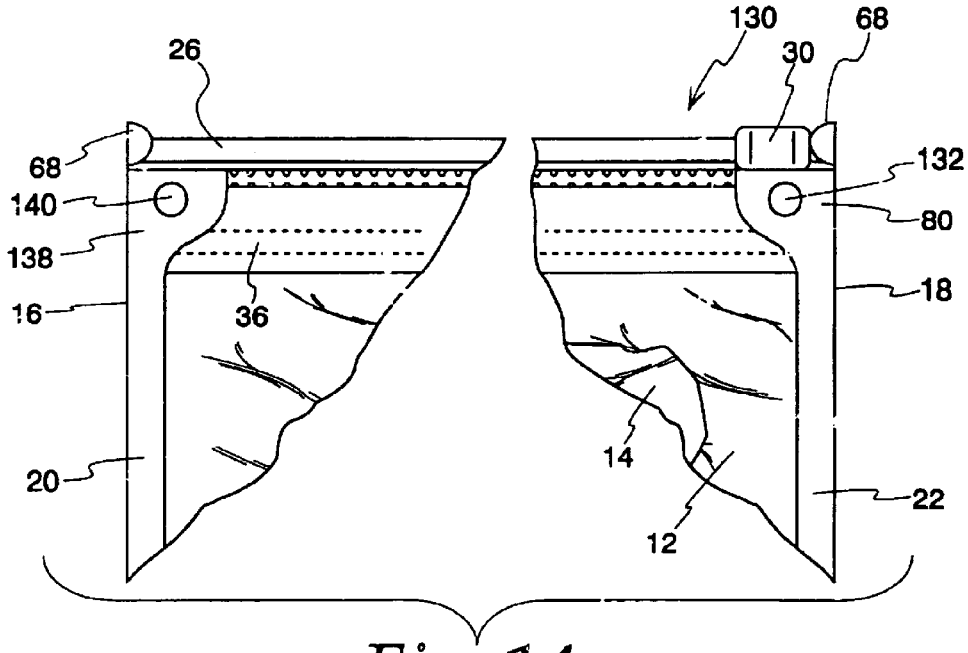
FIG. 14 is a front elevational view of an alternative embodiment of a flexible package according to principles of the present invention.

Referring to FIG. 14, several alternative features are shown with reference to a flexible package 130. The right hand portion of flexible package 130 is identical to flexible package 10, described above, except for the addition of a peg hole 132 formed in the enlarged side seal portion 80. Flexible package 130 has a left side seal 20 as described above with respect to FIG. 1. However, in the flexible package 130, the upper end of side seal 20 is enlarged at 138 in a manner similar to that of enlarged side seal portion 80. An optional peg hole 140 is formed in the enlarged side seal portion 138. Although the peg holes 132, 140 are shown having a circular shape, virtually any shape (e.g., oval) can be used, as well. Peg holes 132, 140 can be formed by punching before or after the side seals are fully formed, it being preferred that the upper ends of the side seals provide a complete sealing of the panels and other components of the flexible package. It will be appreciated by those skilled in the art that the holes add heat relief to the enlarged side seal portion. This helps preserve the uniformity of the tapered area and of the dimensioning of gap g, as well as the uniformity of shrinkage which helps control manufacture on a production basis. If desired, the heat sealing die can be made hollow in the region of the peg holes, even in the absence of peg hole features to attain further heat relief advantages. It may also be preferable in some instances to form the peg holes 132, 140 as part of the formation of the side seals using, in effect, a thermal cutting or thermal punching technique. With the inclusion of two peg holes 132, 140, flexible package 130 can provide an improved presentation of art work or other indicia carried on the panels of the flexible package.

It is generally preferred that textual and graphic information be oriented, generally perpendicular to the side edges of the flexible package. If only one peg hole is provided, the package will tend to hang rotated in a vertical plane, according to the distribution of product within the flexible package. With support given to two peg holes 132, 140, the flexible package is oriented in an upright position, making it easier to read the text and graphical information carried on the package. If desired, the text and graphical information printed on the rear panel can be inverted so that a consumer can "flip" the package to inspect the rear panel, without having to remove the package from the support pegs passing through peg holds 132, 140.

Although the package opening, fastener tracks and related features are shown at the upper end of the flexible package, the present invention is intended to cover arrangements in which the opening and related structure is provided on the side or bottom of the flexible package.

Figure 15:
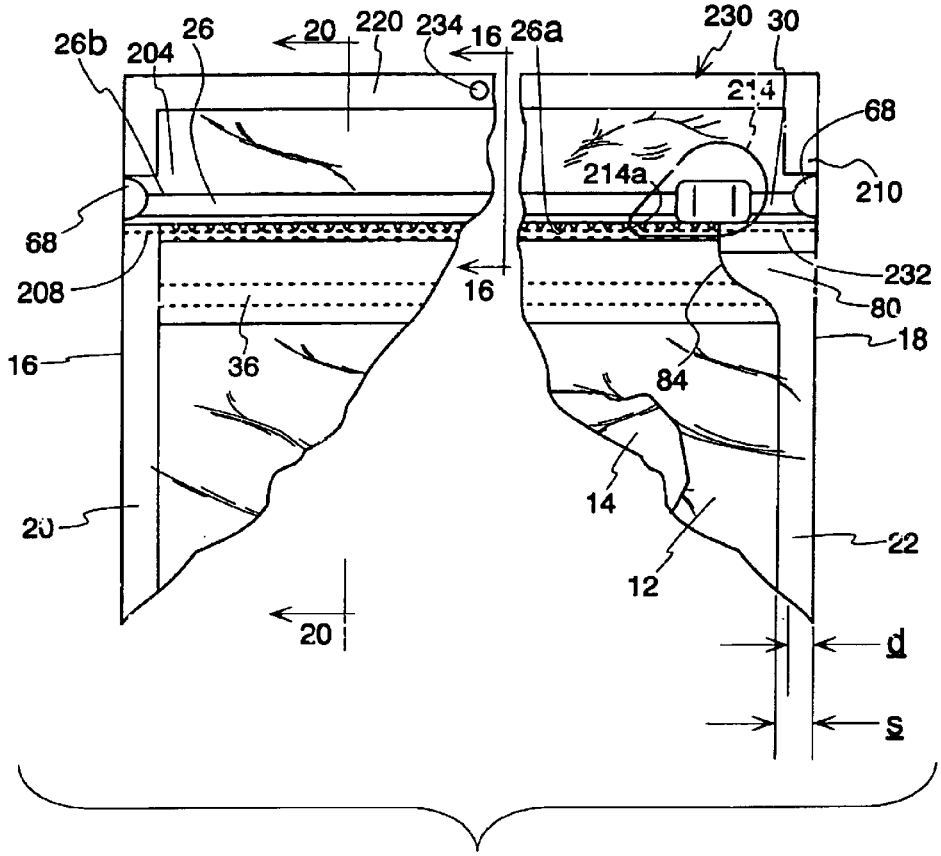
FIG. 15 is a fragmentary elevational view of a shrouded flexible package according to principles of the present invention.
Figure 16:
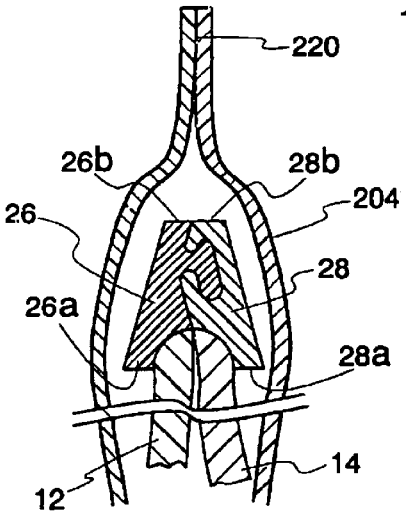
FIG. 16 is a fragmentary cross-sectional view taken along line 16—16 of FIG. 15.
Figure 17:
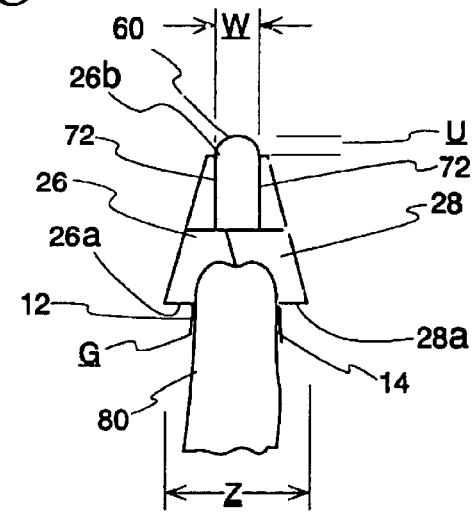
FIG. 17 is a fragmentary end view of the package of FIG. 15.
Figure 25:
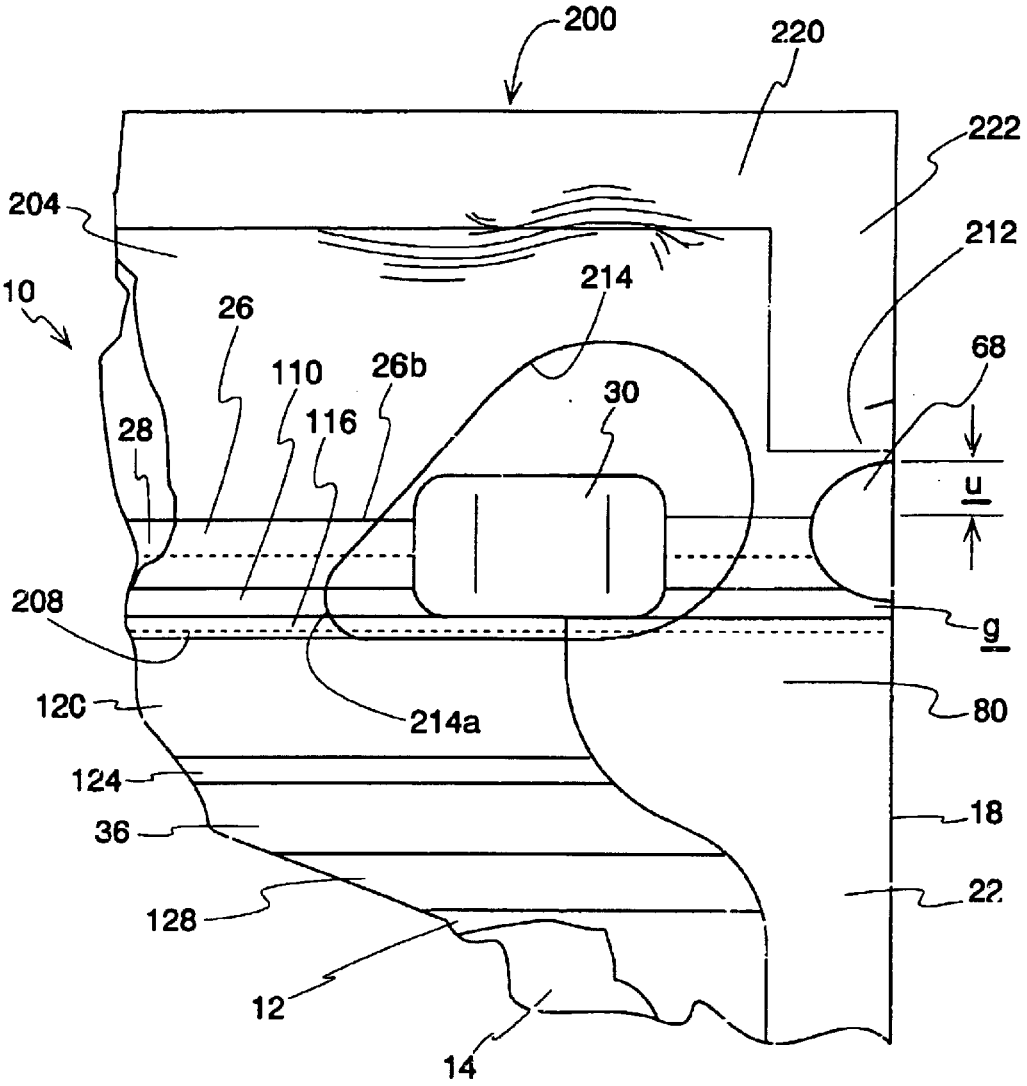
FIG. 25 is a fragmentary elevational view of a further embodiment of a shrouded flexible package.

Referring now to FIGS. 15 and following and initially to FIG. 25, an improved package according to principles of the present invention, is shown. Package 200 includes the features of flexible package 10, described above and in addition includes a shroud portion 204 extending above line of weakness 208 formed in panels 12, 14. Line of weakness 208 can be formed using available conventional techniques, and is preferably formed using laser cutting/scoring techniques. Preferably, line of weakness 208 extends across the width of flexible package 200, from one side edge to the other. As shown line of weakness 208 extends between side seals 20,22.

Preferably, shroud 204 is made for easy tear-away removal in an intuitive manual operation not requiring special directions. Preferably, a tear-start feature 210 is formed in edge 18, and is located slightly above stop 68. The tear-start feature 210 preferably takes the form of a slit, but could also comprise a tear-start feature or other weakening feature, if desired. In the preferred embodiment, as illustrated, the tear-start feature 210 comprises a linear slit extending toward an opening 214 which surrounds slider 30. In the preferred embodiment, the slit line comprising tear-start feature 210 spaced from opening 214 and is terminated within a thin seal 220. If desired, the slit line could extend across the thin seal in a desired, could be made to extend immediately adjacent to or communicating with opening 214. As will be described more fully herein, opening 214 has a pointed or acute angle end 214*a* and the slit line comprising the tear-start feature 210 is generally aligned with the direction of the pointed end 214*a* of opening 214. These features combined to form a convenient directional assist to a consumer during a tear-open operation, ensuring that the tear will continue to a weakening line along with the shroud is severed from the remainder of the flexible package. As will be seen herein, the line of weakness is preferably formed with a laser cutting/scoring operation which ensures a smooth, continuous severing of the shroud from the flexible package.

Preferably, slider 30 is located at a fully closed position along the fastener tracks and is surrounded by opening 214 at the closed position. In order to gain access to the package contents, a user grasps the upper edge of shroud 204 causing an initially tearing at tear-start feature 210. Tearing continues through the shroud material so as to enter opening 214, emerging at the pointed or acute angle end 214*a* through a line of weakness 208 which, as mentioned above, is preferably formed in a laser cutting/scoring operation. Optionally, as mentioned, a diagonal line may extend between the tear-start feature 210 and opening 214. It is generally preferred that such optional line be aligned with the direction of the slit line 210 and the pointed end 214*a*. With continued tearing across line of weakness 208 separation of the shroud is continued the width of package 200, and the shroud 204 is removed, leaving a package substantially similar to the packages described above in FIGS. 1–14.

Referring to FIG. 25, shroud 204 includes an upper fin seal 220 and a side fin seal portion 222. Preferably, the upper fin seal 220 inside fin seal 222 are formed in separate sealing operations and are made to slightly overlap one another for package integrity and sealing of the package interior. The bottom of side fin seal 222 is terminated at or slightly above end stop 68. It is most preferred that side fin seal 222 be terminated slightly above end stop 68 to avoid interfering with the controlled formation of the end stop which, as pointed out above, has a shape and position providing novel advantages. Tear-start feature 210 in the preferred embodiment shown in FIG. 25 is formed at the lower end of side fin seal 222. If desired, tear-start feature 210 could be formed in a gap between end stop 68 and a side fin seal shortened with respect to the side fin seal illustrated in FIG. 25.

Figure 19:
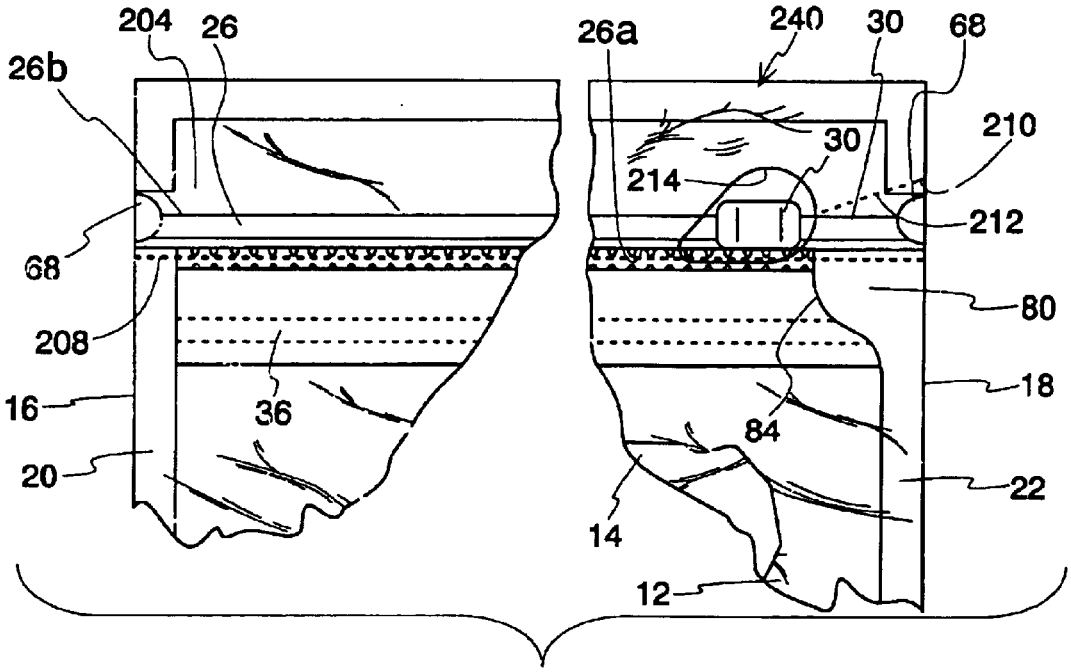
FIG. 19 is a fragmentary elevational view of another embodiment of a shrouded flexible package.

Referring now to FIG. 19, flexible package 240 is substantially identical to flexible package 200, except for the introduction of a line of weakness 212 extending between the tear-start feature 210 and the opening 214. The arrangement of FIG. 19 is preferably employed where the material chosen for the flexible package or at least the shroud portion thereof is easily stretched rather than torn cleanly when subjected to a tearing force. Addition of the weakening line adjoining the tear-start feature and the opening helps to improve the directionality of the tearing force applied by a consumer. Preferably, the direction of tearing force is generally aligned with the direction of the pointed end 214*a* of opening 214.

Figure 20:
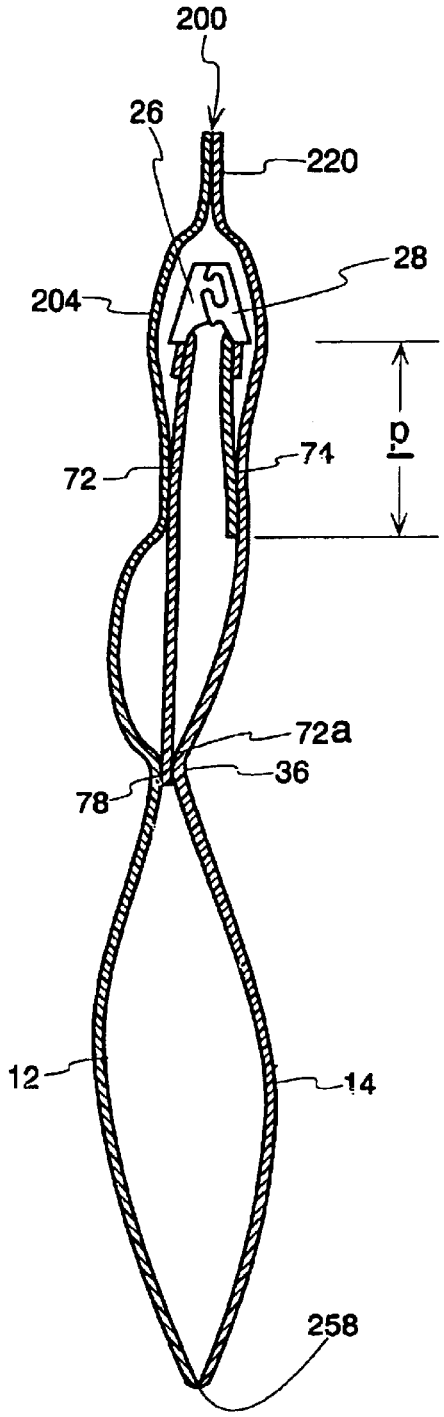
FIG. 20 is a cross-sectional view taken along the line 20—20 of FIG. 15.

Referring now to FIG. 20, a cross section of flexible package 200 is shown. Preferably, shroud 204 is formed as a continuous integral extension of panels 12, 14, the upper free edges of which are joined together to form upper fin seal 220.

Figure 21:
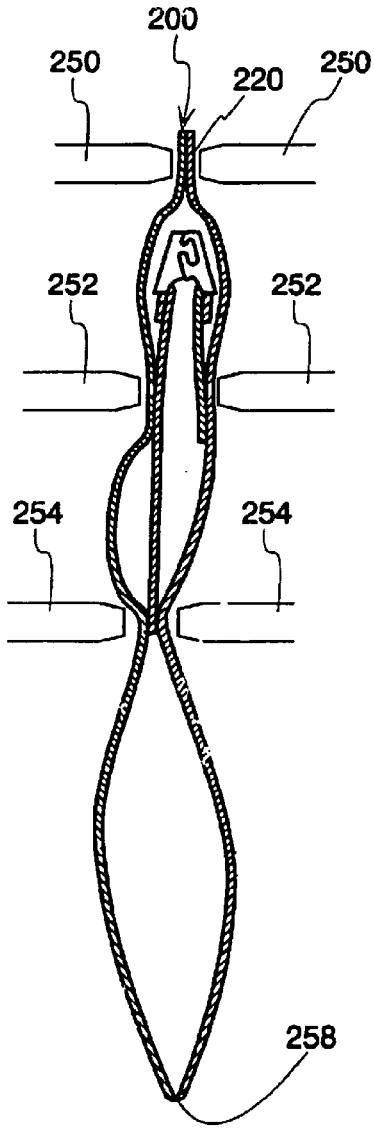
FIG. 21 is a cross-sectional view similar to that of FIG. 20, shown with the schematic depiction of tooling to form the flexible package.

Referring to FIG. 21, exemplary tooling to form the package 200 are shown. For example, a pair of upper seal bars 250 form upper fin seal 220 while a pair of intermediate seal bars 252 join panels 12, 14 to fastener flanges 72, 74. Lower seal bars 254 form the peel seal 36 and weld band 78 (FIG. 20). The bottom of package 200, as is preferred with the other flexible packages shown herein, is formed by a dead fold 258.

Figure 18:
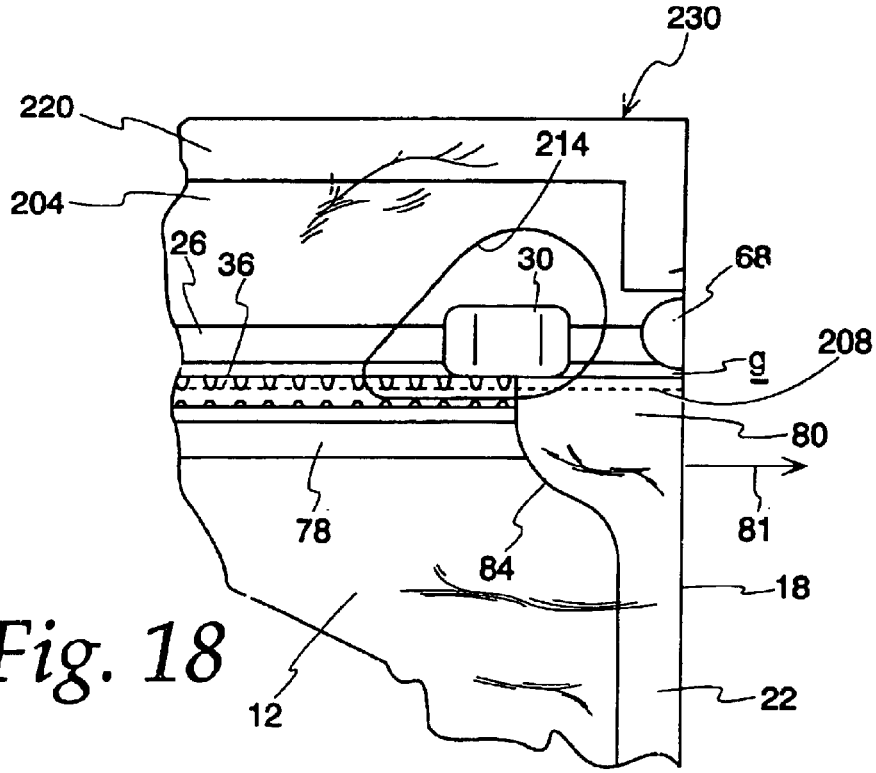
FIG. 18 is a fragmentary elevational view of a further embodiment of a flexible package according to principles of the present invention.
Figure 22:
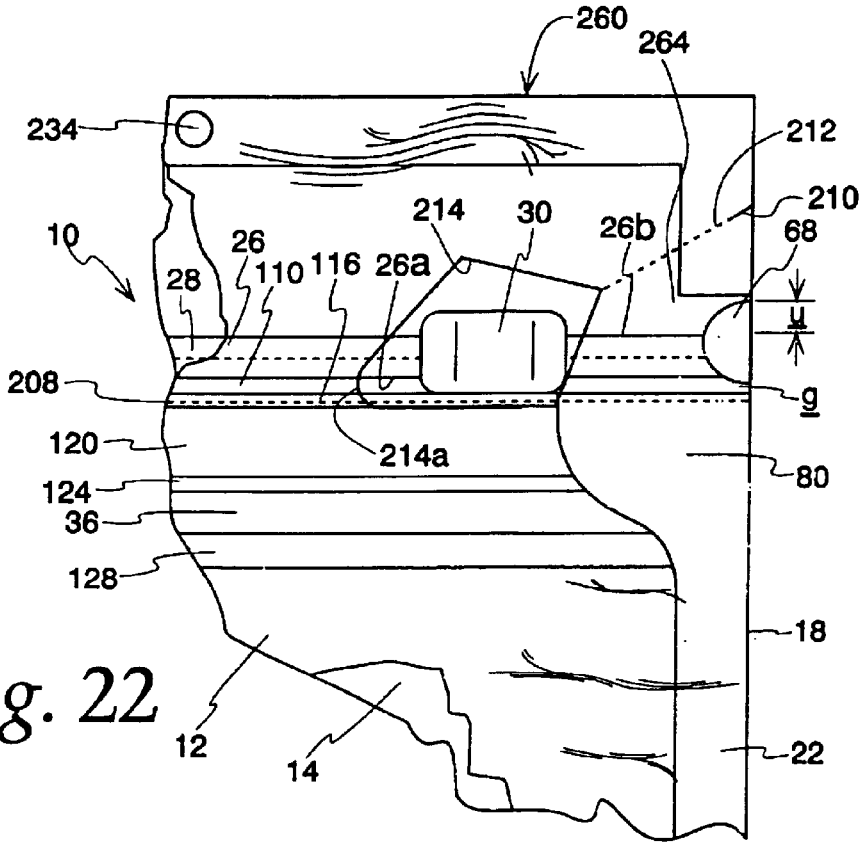
FIG. 22 is a fragmentary elevational view of a further embodiment of a shrouded flexible package.

Referring now to FIG. 22, a flexible package 260 is substantially identical to flexible package 200 of FIG. 18, except that the teardrop-shaped opening 214 is modified to have a generally V-shaped end opposite the pointed end 214*a*. To ensure that tearing enters into hole 214 as desired, it is generally preferred that weakening line 212 bridge the distance between tear-start feature 210 and the adjacent end of hold 214.

Figure 23:
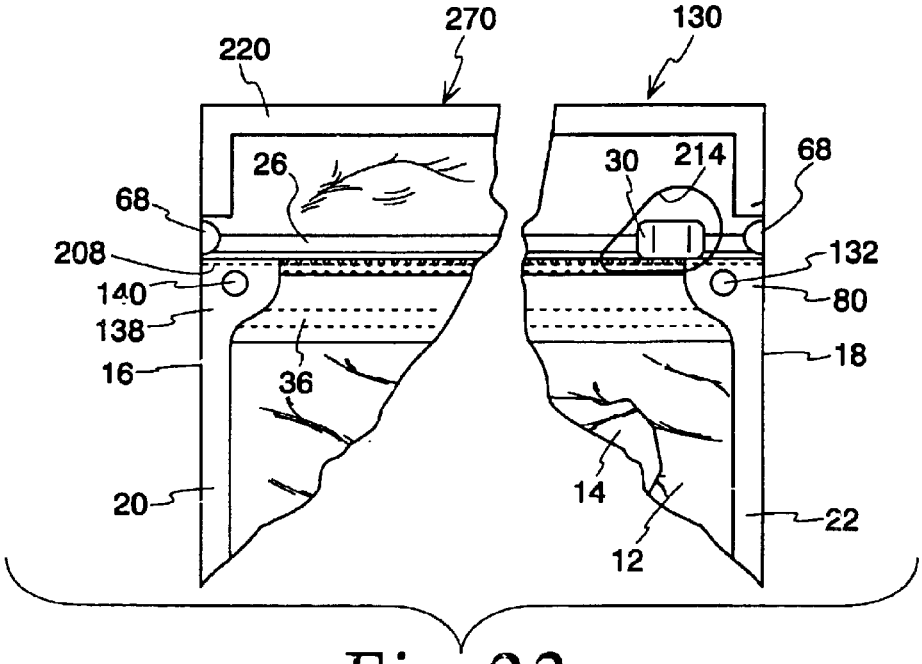
FIG. 23 is a fragmentary elevational view of an additional embodiment of a shrouded flexible package.

FIG. 23 shows a flexible package 270 similar to that of flexible package 200, except that a large or tapered side seals are provided at each side of the package. Peg holes 132, 140 are formed in the tapered side seal portions and if desired an optionally central peg hole 234 can be formed in upper fin seal portion 220. As with the other embodiments shown herein, it is generally preferred that the enlarged or tapered side seal portions stop short of the line of weakness 208.

Figure 24:
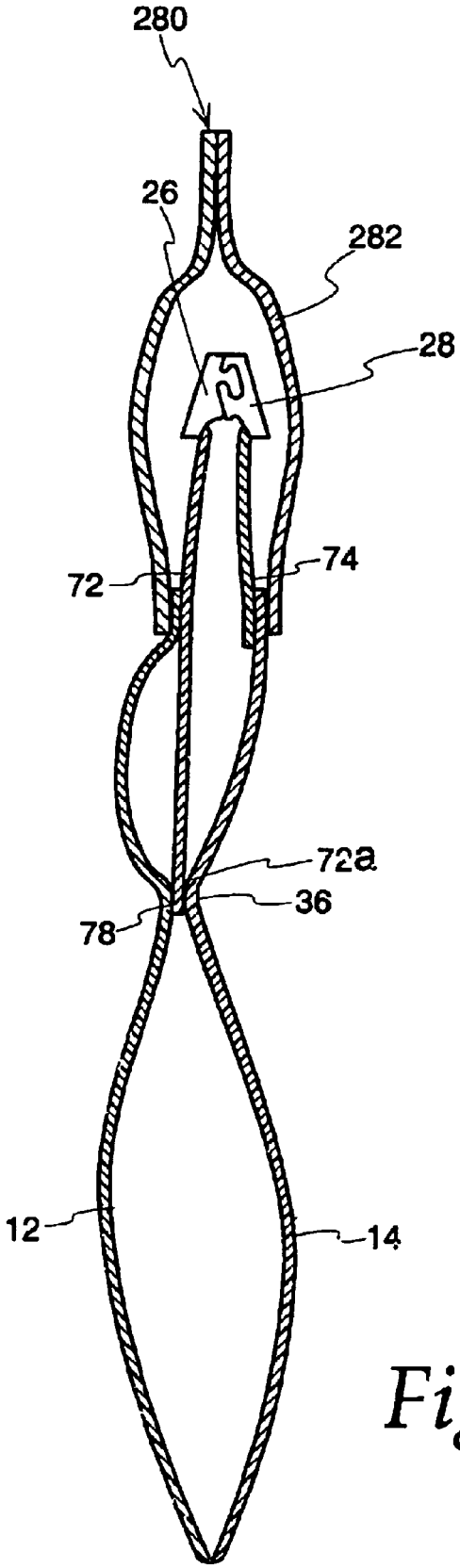
FIG. 24 is a cross-sectional view similar to that of FIG. 20 but showing an alternative shroud construction.

FIG. 24 is a cross-sectional view of an optional flexible package 280 substantially identical to flexible package 200, described above, except that a shroud member 282 is separately formed from panels 12, 14 and is joined to the upper ends of the panels by conventional welding or other joining techniques. Most preferably, shroud 282 is joined to the upper ends of panels 12, 14 at the point of sealing with flanges 72, 74. The weakening line for removal of the shroud of 282 can be formed either above or below the point of sealing with the remainder of the flexible package.

Figure 26:
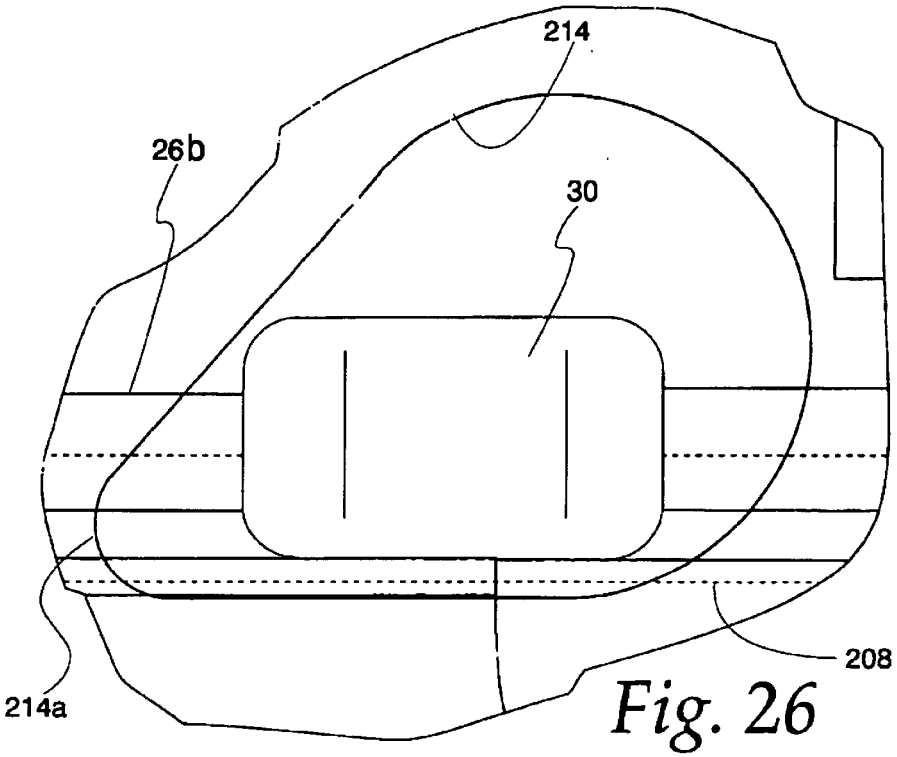
FIG. 26 is a fragmentary view of FIG. 25, shown on an enlarged scale.

FIG. 26 shows an enlarged portion of flexible package 200, to more clearly illustrate the features of opening 214 in cooperation of the opening or hole 214 with the other features of the flexible package. As mentioned above, opening 214 has a pointed end 214*a* arranged so as to extend generally toward a central portion of the package. As shown, end 214*a* forms an acute angle of approximately 45°. If desired, the acute angle can be extended up to 70°. If desired, the pointed end 214*a* can form a sharp corner, but it is generally preferred that a rounded corner be employed, as illustrated. It has been found important for certain types of flexible package materials at the end 214*a* be kept free of minute notches or tears. For reasons of economy, it is generally preferred that opening 214 be used by a die cutting operation and a rounded corner 214*a* has been found to wear in such a manner over its production life so as to avoid tearing or minute notching which could result in misdirection of the tear force applied by a consumer attempting to gain access to the interior of the flexible package.

The acute angle feature of end 214*a* has been found helpful in contributing to the directionality of applied tearing force.

Figure 27:
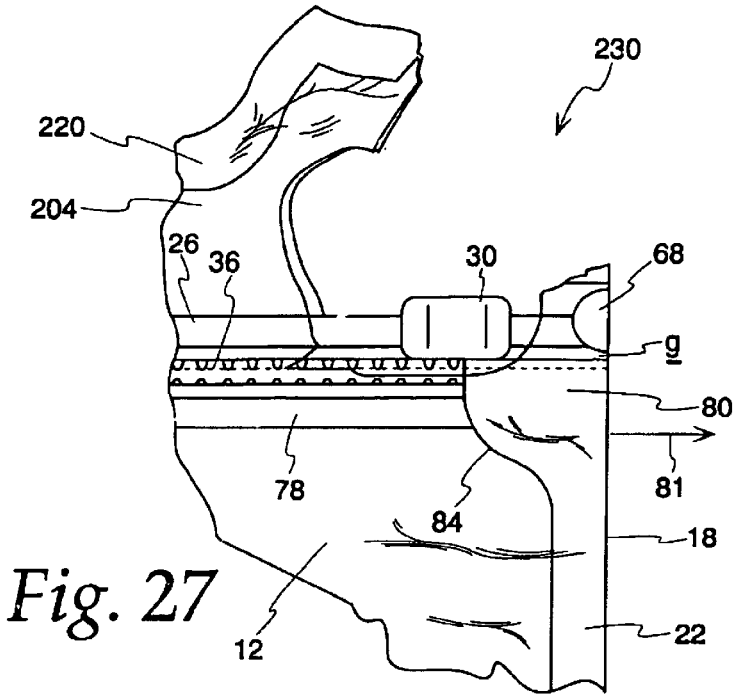
FIG. 27 shows the flexible package being partially opened.

FIG. 27 shows flexible package 200 with the shroud member partially torn away. Tearing of the shroud continues along line 208.

As indicated in the figures, it is generally preferred that the opening 214 have a lower portion extending below line of weakness 208, so as to further ensure that the tearing force will be applied to weakening line 208.

Referring to FIG. 26 for example, the right half of opening 214, generally comprises a semicircle. The present invention also contemplates an arrangement where the left half of the opening also comprises a semicircle. If necessary, the size of the resulting circular opening is increased to provide a space around slider 30 to avoid interference with the slide during opening.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient, and although specific terms have been employed, they are intended in a generic and descriptive sense only and not for the purposes of limitation, the scope of the invention being delineated by the following claims.

What is claimed is:

1. A reclosable flexible package comprising:

opposed front and rear panels having side portions joined together to form an interior and a package opening communicating with said interior;

first and second interlockable fastener tracks joined to said front and said rear panels at said package opening, configurable in an interlocked, closed position and an unlocked open position;

a slider movable along said fastener tracks to configure said tracks in said interlocked position so as to close said opening and to configure said fastener tracks in said unlocked position so as to allow access through said opening to said package interior;

said fastener tracks having opposed ends located adjacent said opposed sides of said front and said rear panels;

stops adjacent said ends of said fastener tracks to interfere with and prevent travel of said slider beyond said fastener tracks;

a side seal of pre-selected width joining together one side of said front and said rear panels;

a shroud covering at least the major portion of said fastener tracks;

weakening portions extending adjacent said fastener tracks severably connecting said shroud to said side portion in preparation for removal of said shroud from the remainder of said reclosable flexible package said weakening portions including a line of weakness extending along the substantial entirely of said fastener tracks and across substantially the entire extent of said reclosable flexible package; and said shroud defining at least one opening for exposing another portion of said slider, said opening having an acute angle portion communicating with said weakening portion.

2. The reclosable flexible package of claim 1 wherein said weakening portion includes a tear-start feature formed in one side of said reclosable flexible package to initiate tearing of said reclosable flexible package.

3. The reclosable flexible package of claim 2 wherein said line of weakness cooperates with said tear-start feature to tear said reclosable flexible package, allowing said shroud to be removed from the remainder of said reclosable flexible package.

4. The reclosable flexible package of claim 3 further comprising an angled weakening line between said tear-start feature and said line of weakness.

5. The reclosable flexible package of claim 4 wherein the said angled severing line crosses said fastener tracks.

6. The reclosable flexible package of claim 5 wherein the said line is a generally straight line.

7. The reclosable flexible package of claim 4 wherein said opening through which said slider protrudes, said opening connecting said angled severing line and said line of weakness.

8. The reclosable flexible package of claim 1 wherein said shroud includes an upper portion comprising a fin seal.

9. The reclosable flexible package of claim 8 wherein said shroud further includes a side fin seal above said fastener tracks, in line with the side seal running said front and said rear panels.

10. The reclosable flexible package of claim 1 wherein said shroud is integrally formed with said side portions of said front and said rear panels, comprising monolithic portions of said front and said rear panels, divided by said side portions by said weakening portions.

11. The reclosable flexible package of claim 1 wherein said shroud includes shroud panels separately formed and joined to said front and said rear panels by said weakening portions.

12. The reclosable flexible package of claim 1 further comprising a peelable seal cooperating with the side portions to prevent communication of said opening with said package interior.

13. The reclosable flexible package of claim 12 wherein said peelable seal comprises a hermetic seal.

14. The reclosable flexible package of claim 1 wherein said steps comprise deformed end portions of said fastener track.

15. The reclosable flexible package of claim 14 wherein said fastener track end portions are softened with application of ultrasonically generated heat and deformed under pressure.

16. The reclosable flexible package of claim 15 wherein the bottoms of said fastener tracks are preserved undeformed.

17. A reclosable flexible package comprising:

opposed front and rear panels having side portions joined together to form an interior and a package opening communicating with said interior;

first and second interlockable fastener tracks joined to said front and said rear panels at said package opening, configurable in an interlocked, closed position and an unlocked open position;

a slider movable along said fastener tracks to configure said tracks in said interlocked position so as to close said opening and to configure said fastener tracks in said unlocked position so as to allow access through said opening to said package interior;

said fastener tracks having opposed ends located adjacent said opposed sides of said front and said rear panels;

stops adjacent said ends of said fastener tracks to interfere with and prevent travel of said slider beyond said fastener tracks;

a side seal of pre-selected width joining together one side of said front and said rear panels;

a shroud covering at least the major portion of said fastener tracks;

weakening portions extending adjacent said fastener tracks severably connecting said shroud to said side portions in preparation for removal of said shroud from the remainder of said reclosable flexible package said weakening portions including a line of weakness extending along the substantial entirety of said fastener tracks;

said shroud defining at least one opening for exposing another portion of said slider, said opening having an acute angle portion communicating with said weakening portion;

said side seal having an enlarged end portion of enlarged width adjacent said fastener tracks, with at least a part of said enlarged end portion disposed below said fastener tracks; and wherein said enlarged end portion is disposed beneath the substantial entirety of said slider and shields said slider, deflecting product being discharged from said package interior, around said slider.

* * * * *

UNITED STATES PATENT AND TRADEMARK OFFICE

CERTIFICATE OF CORRECTION

PATENT NO. : 6,974,256 B2
DATED : December 13, 2005
INVENTOR(S) : Kinigakis et al.

It is certified that error appears in the above-identified patent and that said Letters Patent is hereby corrected as shown below:

Column 13,
Line 7, change "portion" to -- portions --.

Column 14,
Line 2, change "steps" to -- stops --.

Signed and Sealed this

Thirteenth Day of June, 2006

JON W. DUDAS
*Director of the United States Patent and Trademark Office*